United States Patent [19]

Langlitz et al.

[11] Patent Number: 4,516,757

[45] Date of Patent: May 14, 1985

[54] TILTABLE METALLURGICAL CONVERTER HAVING MATERIAL CARRYING LINES

[75] Inventors: Karlheinz Langlitz, Mulheim; Gunter Schmitz, Duisburg, both of Fed. Rep. of Germany

[73] Assignee: Mannesmann Aktiengesellschaft, Dusseldorf, Fed. Rep. of Germany

[21] Appl. No.: 329,050

[22] Filed: Dec. 9, 1981

[30] Foreign Application Priority Data

Dec. 20, 1980 [DE] Fed. Rep. of Germany ..... 3048199

[51] Int. Cl.[3] ..... C21C 5/50

[52] U.S. Cl. ..... 266/245; 75/60

[58] Field of Search ..... 266/245; 75/60

[56] References Cited

U.S. PATENT DOCUMENTS

| | | | |
|---|---|---|---|
| 4,138,097 | 2/1979 | Farber | 266/245 |
| 4,198,230 | 4/1980 | Brotzmann | 75/60 |
| 4,325,540 | 4/1982 | Seki | 266/245 |

*Primary Examiner*—Peter D. Rosenberg

*Attorney, Agent, or Firm*—Mandeville and Schweitzer

[57] ABSTRACT

A tiltable metallurgical vessel is rotatable about pivot pins which are supported in bearings. At least one of the pivot pins is hollow so that a material carrying conduit can pass through the pivot pin desired materials from a remote source to a desired operational site of the furnace. In addition, other material carrying conduits are provided to the operational sites of the furnace. These latter conduits are connected, at one end, to stationary tapping points and, at the other end, to the operational sites of the vessel. The conduits are guided around (by being coiled by at least one full turn) an enlarged cylindrical portion of the hollow pivot pins.

In one embodiment of the invention, the enlarged cylindrical portion of the hollow pins are winding drums which are themselves constructed of symmetrical cylinder halves. In this manner, the winding drum can be easily retrofitted onto a preexisting vessel.

In another aspect of the invention, a tensioning device is provided for the elimination of slack of the flexible conduits. The tensioning device, in the preferred embodiment, is in the form of a weighted guide roller.

9 Claims, 3 Drawing Figures

TILTABLE METALLURGICAL CONVERTER HAVING MATERIAL CARRYING LINES

BACKGROUND OF THE INVENTION AND DESCRIPTION OF THE PRIOR ART

The invention relates to a metallurgical vessel, particularly a steel manufacturing furnace or converter. Such a vessel is pivotally supported by a pair of pivot pins. The pivot pins are supported in bearings for facilitating rotational movement necessary for tapping or pouring. According to the invention, at least one of the pivot pins is hollow and carries conduits which either function as material providing inlets or, if desired, material drains to or from the vessel, respectively. The type of materials supplied to or eliminated from the furnace can be liquid coolants and/or other liquid, gaseous or solids and/or powdered metallurgical processing materials.

A tilting furnace or vessel having hollow pivot pins provides a material passageway through the pivot pin support bearings. Since such a metallurgical vessel rotates about the pins while tilting for tapping purposes, an additional length of flexible tubing, i.e., slack, if flexible pressure hose lines are used, is required. One of the two hollow pivot pins serves to supply a liquid useful in the steelmaking process such as, for example, cooling water, and the other hollow pivot pin serves as a drain for the water which is partially heated by the heat of the furnace. The supplied and drained water simultaneously serves to cool the pivot pin support bearings, which bearings usually contain heat-sensitive, built-in roller bearings.

As used herein, all materials desirable or necessary for a steel making process carried out in a metallurgical vessel are designated "manufacturing components". Included within the category of manufacturing components but not limited to this partial listing are compressed air, inert gases at elevated pressure or even hydraulic fluids useful, for example, for activating mechanically sliding shutters, elements which are arranged within the steelmaking vessel.

"Processing materials", as used herein, includes but is also not limited to, materials directly used in the steelmaking process such as gases, e.g. oxygen ($O_2$), inert gases (nitrogen, argon), air, as well as powdered lime, coal dust, etc.

The relatively recently developed technology of purifying (including decarburizing, oxidizing by blowing, converting, annealing, reducing and refining of liquid metals) in tilting vessels necessitate the supply of great quantities of gas, fluids, and dust materials to the metallurgical furnace, as compared to that deemed necessary by past technology. In addition to the increase in sheer volume, the various types of processing materials must also be taken into account. The diameter of the hollow pivot pins define a relationship of the speed of the processing materials which can be delivered to the furnace at a given pressure. Using the diameter of the conduit and the speed of the material sought to be supplied, the maximum supplied quantity of the material, per time unit, can be determined by resorting to a fluid dynamics type equation.

The speed, pressure and volume of material through the pivot pin are also considerably limited by the subdivision of the cross section of the hollow pivot pin into three concentric pipe cross sections. There are, presently, no material carrying pipelines which extend beyond the existing pivot pin cross sections for feeding in processing material or manufacturing components of various kinds.

German reference P 20 65 176 shows the use of a hollow pivot of a steel manufacturing converter for compressed air lines. In addition, that reference discloses the concept of mounting a movable line guide outside yet closely adjacent to the support bearing of the pivot pins. The disadvantage of such a design, however, is that there are only a few compressed air lines made available and, therefore, a large variety of manufacturing components and processing materials may not be fully utilized nor even considered in the planning stage.

SUMMARY OF THE INVENTION

The above described objectives are achieved, according to the present invention, by providing besides the inlets for the manufacturing components and/or the processing materials through the hollow pivot pin, material carrying lines outside the pivot pins for carrying liquid, gaseous and/or powdered processing materials and/or manufacturing components to selected sites at the furnace. The material carrying lines are attached, on one end, to a stationary tapping point located between the vessel and the support bearing, and are guided around an enlarged section of the pivot pin and connected with the pertinent operating site of the vessel. The material carrying lines have relative greater cross sections between the stationary tapping point and the inlets to the vessel, since it is here that the lines are subject to twisting, stretching, etc. during movement of the vessel. The larger flow cross section of the hollow pivot pins can be used for the manufacturing components and/or, if required, for providing processing materials while the material carrying lines, having relative smaller cross sections, can be used for whichever material can be transported through small cross sectional conduits. For these relatively small in cross section material carrying lines, the distance between the pivot pin and the support bearing is sufficient for adjacently arranging a great number of material carrying lines.

According to yet another feature of the invention, the material carrying lines are threaded through apertures located in the vessel support ring and then connected to the pertinent operational site at the vessel. This mounting arrangement serves to ensure better protection for the material carrying lines, particularly against the deleterious effects of temperature fluctuations and mechanical damage.

According to another feature of the invention, an enlarged portion of the pivot pins for the guided arrangement of the material carrying lines is eliminated, since the material carrying lines are, in this embodiment, guided around a winding drum which is itself fastened onto the pivot pin at a position located between the support bearings and the metallurgical vessel. The winding drum is to be interposed between the roller bearings for the pivot pin and the support ring of the metallurgical vessel.

In order to facilitate the adaptation of such a winding drum after the vessel, pivot pin and bearings are already in existence, it is an aspect of this invention to manufacture the winding drum as two axially symmetric, radially separated semi-cylindrical elements, of which the inner diameters correspond with the outer diameter of the pivot pin. In this manner, retrofitting of existing furnaces can easily occur.

The periodic tilting for steel tapping of the vessel may result in the material carrying lines becoming kinked, twisted or otherwise damaged. This difficulty. is avoided by having the material carrying lines, starting from the stationary tapping points, guided around a constant tension-providing guide roller which is arranged below the winding drum. The tension, provided by the guide roller, may be provided in a very simple manner, i.e., by attaching a weight to the unsupported guide roller.

One of the basic inventive thrusts of the present invention is the creation of many separate material carrying lines for manufacturing components and processing materials. This opens up significant manufacturing possibilites for the use of manufacturing components and processing materials. To further develop the invention it is, therefore, contemplated that the operating sites for the materials provided to the vessel comprise the vessel-cap cooling mechanism, the vessel-mouth cooling mechanism, the vessel support-ring cooling installation, or lances for the processing materials. These lances may pass through a side wall or bottom of the vessel. Other forms of the lances may exist, e.g., they can extend through the mouth of the vessel into the area of the smelt or the lances can either be immersed into the smelt or remain above the surface level of the smelt.

A preferred embodiment of the present invention is shown in the drawings and detailed as follows.

DETAILED DESCRIPTION OF THE DRAWINGS

Figure 1:
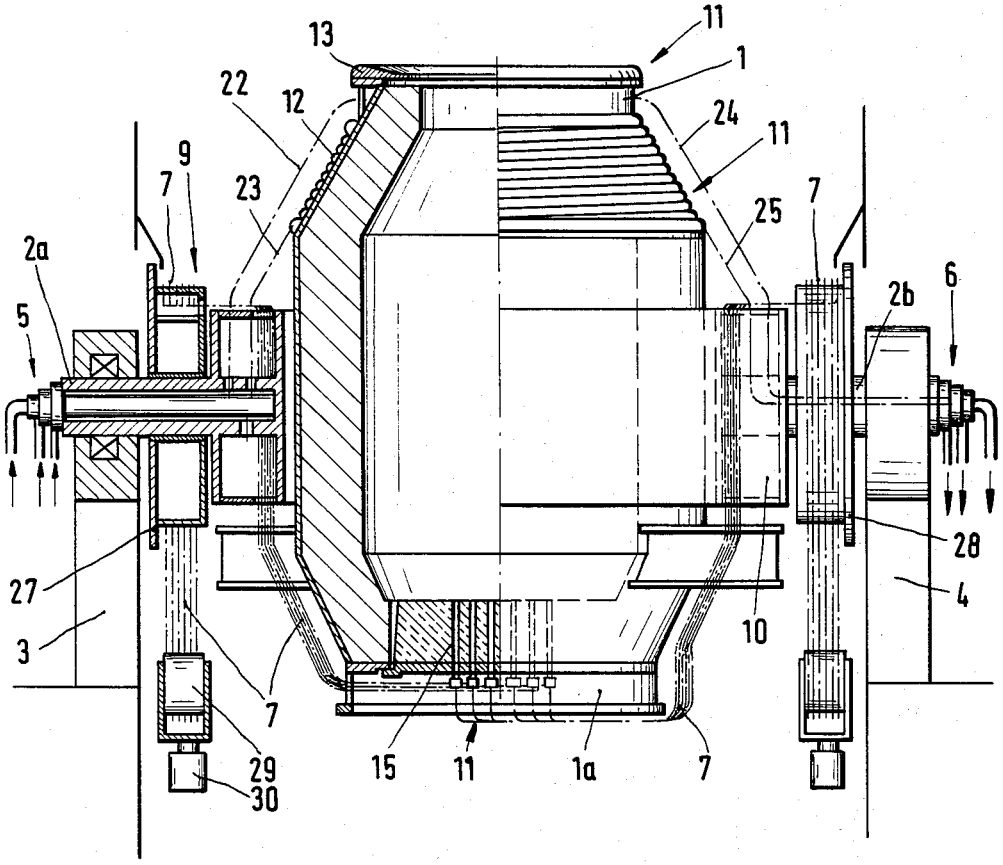
FIG. 1 is a cross sectional view of a steel manufacturing converter or vessel, equipped with the present invention.
Figure 2:
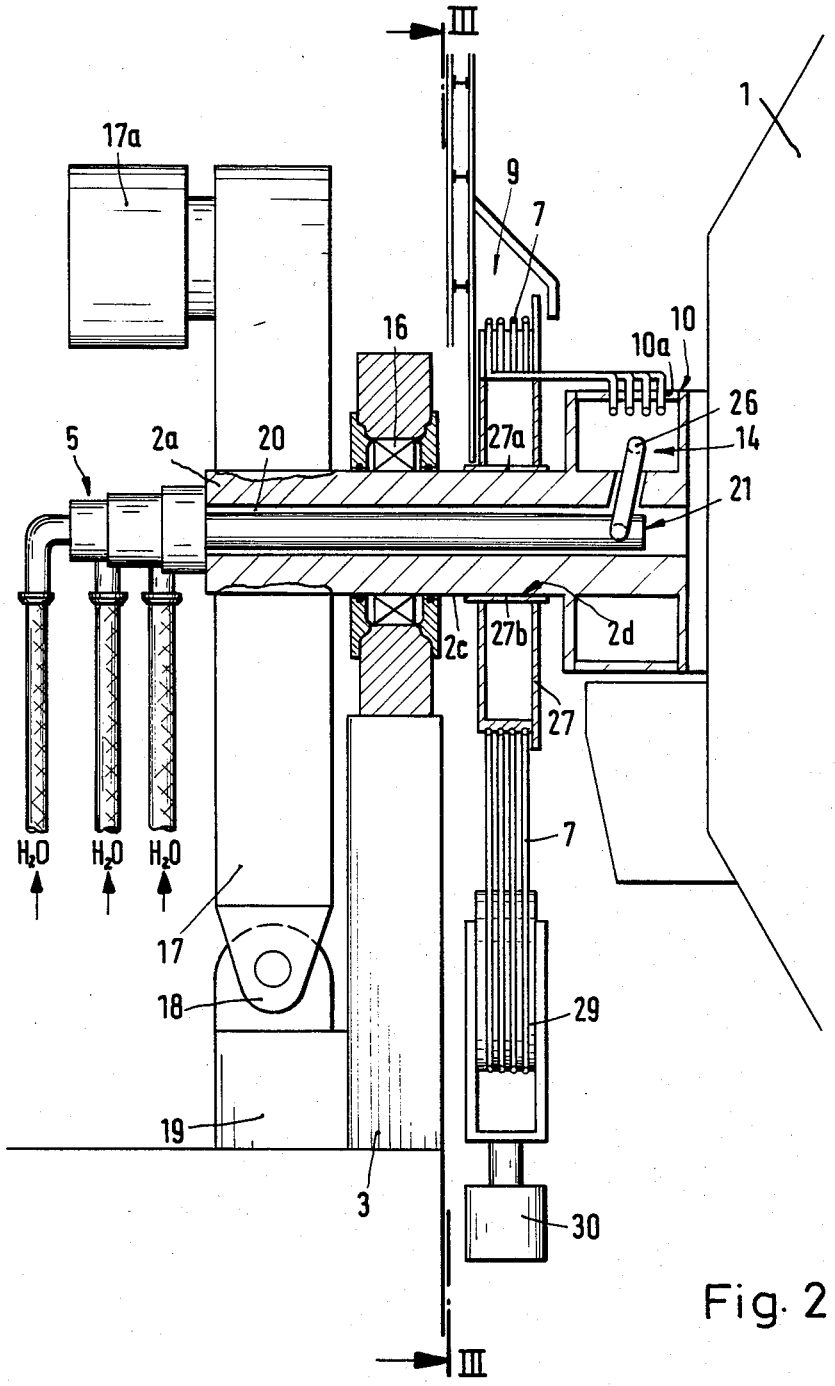
FIG. 2 is an enlarged, partial vertical cross sectional view of the vessel shown in FIG. 1, the view taken through one of the two hollow pivot pins.

As best seen in FIGS. 1 and 2, a steel manufacturing or metallurgical converter or vessel 1 is pivotally supported in support bearings 3. A pair of pivot pins 2*a* and 2*b* are mounted to the vessel 1 and supported in the support bearings 3 and 4, respectively. Both pivot pins 2*a* and 2*b* are hollow. The pivot pin 2*a* provides an inlet or material feed-in 5 for the manufacturing components and, if desired, processing materials, while the hollow pivot pin 2*b* forms a material outlet or drain 6 for the manufacturing components.

In addition to the inlet 5 for the manufacturing components and the processing materials, a plurality of, for example, between six and twenty material carrying lines 7 are provided to vessel 1. Each material carrying line 7 is connected at one end to a stationary tapping point 8 (see FIG. 3) and extends to an enlarged-in-diameter section 9 of pivot pin 2*a*. This section 9 can be integral with the hollow pivot pin 2 or, alternatively, as discussed hereafter, can be a separate winding drum. The diameter of line 7, where it is wrapped around section 9, is greater than the diameter of line 7 prior to tapping point 8 so that the permissible bending stress of the material carrying lines is not exceeded. The material carrying lines 7 connect to the vessel support ring 10 by passing through apertures 10*a* (FIG. 2) of the support ring 10. From the apertures 10*a* of the support ring 10, the material carrying lines 7 are subsequently guided to the ultimate operating sites 11 of the vessel, wherever the materials carried by the conduit are to be used.

Operating sites 11, for example, may be the vessel-cap cooling mechanism 12, the vessel-mouth cooling mechanism 13, the support-ring cooling mechansim 14, or lances 5 (shown in FIG. 1 as bottom-blowing lances).

The arrangement just described for the material carrying lines 7 can also be provided at the pivot pin 2*b* (FIG. 1). These lines can either be additional material feed-ins or inlets or, alternatively, can be material outlets or drains.

The arrangement of the material carrying lines 7 is shown on an enlarged scale in FIG. 2 for the left side of vessel 1. As shown therein, the vessel 1 is supported by a support ring 10 which surrounds vessel 1. The pivot pin 2*a*, extending from the support ring 10, is supported by support bearing 3, said bearing being equipped with roller bearings 16 which facilitate rotation and tilting of the vessel 1 and pin 2*a*. A pivot pin drive mechanism 17 engages the pivot pin 2*a* and serves to selectively rotate the vessel, as desired. The pivot pin drive mechanism 17 holds the drive-reaction moment at the foundation 19 by a torque support 18. The drive motor 17*a* is, of course, connected to the pivot pin drive mechanism 17.

The pivot pin drive mechanism 17, the roller bearing 16 and the vessel support ring 10 can be cooled by a liquid coolant, such as, for example, water, which material flows in the concentrically arranged conduit 20 and the pipe 21. This coolant is drained on the opposite side of the vessel 1 through the pivot pin 2*b*.

Special fluid or material carrying lines are provided for each of the various operating sites 11. For instance, rigid pipe line 22 (see FIG. 1) is branched off from the conduit 20 (see FIG. 2) and supplies cooling fluid to the vessel-mouth cooling mechanism 13. The additional rigid pipe line 23 (see FIG. 1) supplies cooling fluid to the vessel-cap cooling mechanism 12. The rigid pipe lines 24 and 25 form the appropriate return or drain lines of the now-heated cooling fluid. The additional pipe line 26 branches off from material carrying pipe 21 (see FIG. 2) and provides a fluid coolant to the vessel support ring 10.

The enlarged section 9 is enlarged in its diameter with respect to the roller bearings 16 and the height of the supporting ring 10. In the preferred embodiment, section 9 comprises a winding drum 27; winding drum 28 is shown on the right side of vessel 1 in FIG. 1, associated with pivot pin 2*b*.

The winding drums 27 and 28 are firmly connected to the appropriate pivot pins 2*a* and 2*b*. The winding drums are constructed from welded sheet metal parts and formed into half cylinders or disc halves 27*a* and 27*b* which are bolted to one another at their flanges. The inner diameter 2*d* of disc halves 27*a* and 28*a* corresponds to the pivot-pin outer diameter 2*c*. It is possible, because of the construction of the winding drums from disc halves, to retrofit a pre-existing furnace with winding drums 27 and 28.

The vessel 1 is intended to pivot around 360°. Sometimes a greater rotation is performed. A guide roller 29 (see FIG. 3) in the form of a pully wheel is freely suspended from the material carrying lines 7. The guide roller 29 is always under tension which is maintained by the existence of a weight 30 which serves to ensure an orderly winding and unwinding action of the material carrying lines. By having an additional length of the material carrying line 7 pass around the guide roller 29, the furnace can freely rotate while still ensuring a fluid connection between the remote source of material and the furnace operating site.

Figure 3:
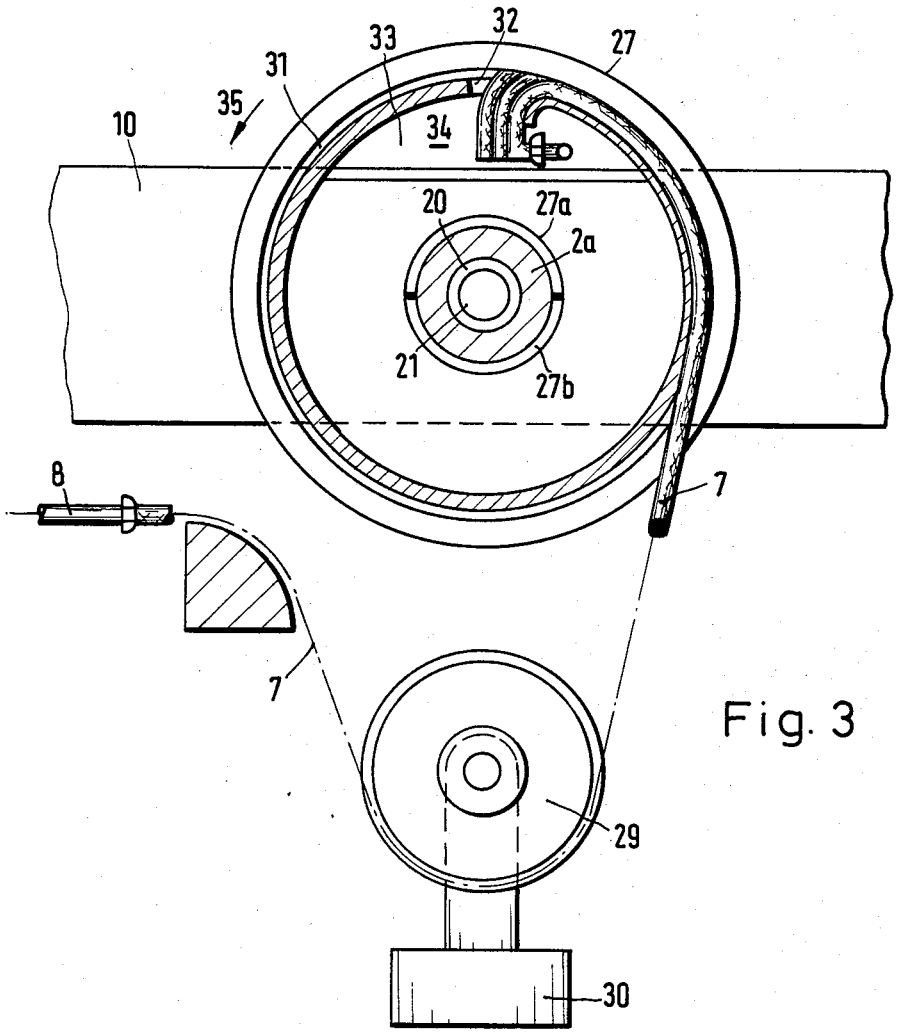
FIG. 3 is a partial cross sectional view taken through the hollow pivot pin along lines III—III of FIG. 2 in the direction shown by the arrows.

Only a single compressed air line 7 is shown in FIG. 3. At least one groove 31 is, however, provided on the winding drum 27 for each material carrying line 7. The grooves serve to guide and maintain the material carrying lines 7 during the rotation of the vessel. The grooves 31 are designed with a thread-type elevation for more than one entire revolution so that two or more groove paths are adjacent to each other. An aperture is located at a circumferential point 32 of the winding drum 27 (see FIG. 3). All of the material carrying lines 7 pass through this aperture into the interior space 33 of the winding drum 27 and, from there, through the frontal wall 34 of the winding drum 27 and then to the support ring 10.

As the pivot pins 2*a* and 2*b* revolve by means of pivot drive mechanism 17 in turning direction 35 (see FIG. 3), the material carrying lines 7 are wound up on the winding drums 27, 28 and the guide roller 29 is raised due to the shortened length or loss of slack of the material carrying lines 7.

The material carrying lines 7 can carry (see FIG. 3) lime, oxygen ($O_2$), coal dust (C), water ($H_2O$), nitrogen ($N_2$), argon, or air. These materials representing examples of the manufacturing components used in steel manufacturing processes which are directed to the desired operating sites. It is, however, important, from a safety standpoint, that materials which should not react chemically with one another not be brought into close contact with one another. Cooling water may, if desired, also be conducted through one of the material carrying lines 7.

Instead of having the flexible material carrying lines 7 extend to the area of the bottom plate 1*a* of the vessel 1, rigid pipe conduits may extend from the support ring 10 to the appropriate operating sites 11 with the flexible material carrying lines 7 extending from the tapping point 8 to the support ring 10.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A tiltable metallurgical converter comprising:

(a) a metallurgical vessel having at least one operational site;

(b) a pair of pivot pins secured to said vessel;

(c) support bearings for said pivot pins;

(d) said pivot pins and support bearings serving to allow rotation of said vessel about a horizontal axis passing through said pivot pins when said pivot pins are selectively rotated;

(e) at least one of said pivot pins being hollow;

(f) at least one material carrying line passing through the interior of said hollow pivot pins, said material carrying lines connected on its first end to a remote source of material;

(g) at least one enlarged, in diameter, portion of said hollow pivot pin, located between said support bearing of said hollow pivot pin and said vessel;

(h) at least one additional material carrying line having its first end connected to a stationary tapping point;

(i) said tapping point being connected to a second remote source of material;

(j) said additional material carrying lines being guided by at least one full turn around said enlarged, in diameter, portion of said hollow pivot pin; and (k) the second ends of said material carrying lines and said additional material carrying lines being connected to said operational sites.

2. A metallurgical converter as claimed in claim 1, wherein:

(a) said vessel is provided with a support ring;

(b) said support ring has at least one aperture; and (c) said additional material carrying lines, guided around said enlarged portion of said hollow pivot pin, pass through said apertures of said support ring.

3. A metallurgical vessel as claimed in claim 1, wherein:

(a) said enlarged, in diameter, portion of said hollow pivot pin is a separate winding drum;

(b) said winding drum comprises two separable, matingly engagable semi-cylindrical halves; and (c) the inside diameter of said halves corresponds to the outside diameter of said hollow pivot pin.

4. A metallurgical vessel as claimed in claim 1, wherein:

(a) said additional material carrying lines, connected to said stationary tapping points, are guided around a tension-loaded guide roller located between said stationary tapping point and said enlarged, in diameter, portion of said hollow pivot pin.

5. A metallurgical vessel as claimed in claim 4, wherein:

(a) said tension-loaded guide roller is held under constant tension by a weight hanging from said guide roller.

6. A metallurgical vessel as claimed in claim 1, wherein:

(a) said operational site is the cooling mechanism for the vessel cap.

7. A metallurgical vessel as claimed in claim 1, wherein:

(a) said operational site in the cooling mechanism for the vessel mouth.

8. A metallurgical vessel as claimed in claim 1, wherein:

(a) said vessel is provided with a support ring; and (b) said operational site is the cooling mechanism for said support ring.

9. A metallurgical apparatus as claimed in claim 1, wherein:

(a) said operational sites are lances extending into said vessel.

* * * * *